US006450212B1

(12) United States Patent
Quick

(10) Patent No.: US 6,450,212 B1
(45) Date of Patent: Sep. 17, 2002

(54) SOLID STATE WEB TAKE-UP CONTROL

(75) Inventor: Bobby E. Quick, Taylors, SC (US)

(73) Assignee: Diversified Systems, Inc., Greenville, SC (US)

( * ) Notice: Subject to any disclaimer, the term of this patent is extended or adjusted under 35 U.S.C. 154(b) by 0 days.

(21) Appl. No.: 09/903,386

(22) Filed: Jul. 11, 2001

(51) Int. Cl.[7] ..... D03D 49/20
(52) U.S. Cl. ..... 139/311; 226/44; 242/413.6
(58) Field of Search ..... 139/311; 226/44; 242/413.6

(56) References Cited

U.S. PATENT DOCUMENTS

| | | | | |
|---|---|---|---|---|
| 2,104,656 A | | 1/1938 | Krejci | 242/45 |
| 2,509,250 A | | 5/1950 | Roberts | 242/45 |
| 2,752,553 A | | 6/1956 | Dunlop, Jr. | 321/46 |
| 3,525,367 A | | 8/1970 | Sprague | 139/1 |
| 4,146,190 A | | 3/1979 | Bond et al. | 242/75.51 |
| 4,216,804 A | | 8/1980 | Alexander, III et al. | 139/311 |
| 4,564,050 A | | 1/1986 | Hirano | 139/97 |
| 4,566,646 A | | 1/1986 | Benjamin | 242/45 |
| 4,633,914 A | | 1/1987 | Carry | 139/1 |
| 5,069,257 A | * | 12/1991 | Borisch | 139/99 |
| 5,170,611 A | * | 12/1992 | Buchko et al. | 226/44 |
| 5,524,461 A | | 6/1996 | Nielsen et al. | 66/210 |
| 5,546,993 A | * | 8/1996 | Summey, III et al. | 139/311 |

* cited by examiner

*Primary Examiner*—Andy Falik
(74) *Attorney, Agent, or Firm*—McNair Law Firm, P.A.; Cort Flint

(57) ABSTRACT

An off-loom take-up for winding a cloth roll from woven cloth coming from a loom which includes a frame and a pair of spaced take-up rollers carried by the frame, at least one of the take-up rollers is a driven take up roller. A drive motor with an output shaft drives the driven take-up roller, and a motor controller is provided for controlling the speed of the output shaft of the drive motor. A pivotal dancer roll assembly is carried by the frame and includes a pivotal dancer roll under which the cloth travels from the loom to the cloth take-up roll. A voltage sensor responsive to the movement of the pivotal dancer roll outputs a plurality of voltage signals correlated to a plurality of different pivotal positions of the dancer roll. An electronic limit processor is provided for receiving the voltage signals, the processor processing the voltage signals to generate a control signal which is output to the motor controller for controlling the drive motor.

7 Claims, 6 Drawing Sheets

SOLID STATE WEB TAKE-UP CONTROL

BACKGROUND OF THE INVENTION

The invention relates to the field of textiles, or other sheet material, and more particularly to the winding or unwinding of a web of such material using a solid state take-up control to ensure uniform tension and reduced defects in the roll.

In the textile process of weaving cloth on a loom, the finished cloth is typically wound into a cloth roll upon leaving the loom. The cloth roll may be wound by a "take-up" device either on the loom or off the loom. The present invention has particular advantages with an off-loom take-up. The off-loom take-up typically includes a pair of spaced take-up rollers which are driven by an electric drive motor through a speed reducer and a suitable drive, such as a chain and sprocket drive. The cloth roll is supported on the take-up rollers which rotate the cloth roll to take-up and form the cloth roll. It is important that the layers of the cloth roll are wound at a generally uniformed tension so that skewing and other undesirable characteristics of the cloth on the cloth roll are avoided.

Previously, various controls for the drive motor of the take-up rollers have been provided to impart desirable characteristics to the final cloth roll package. For example, U.S. Pat. No. 3,525,367, discloses an off-loom take-up having a tension control apparatus which selectively controls the linear rate of the warp yarn fed to the loom to automatically maintain a predetermined amount of tension on the warp yarns, and also maintain a uniform tension on the woven cloth coming from the loom as it is wound on the cloth take-up device. The cloth roll is supported on a cradle provided by spaced take-up rollers upon which the cloth roll is rotated and wound. For this purpose, the drive motor for the take-up rollers is provided so that the torque output of the motor is controlled. As the windings of the cloth roll accumulate, the increased loading on a driven take-up roller and drive motor is continuously sensed, and the torque output of the drive motor is continuously adjusted to maintain a preset fabric tension level.

U.S. Pat. No. 4,146,190, also discloses a control system for an off-loom take-up wherein an additional improvement is sought by using a spring biased dancer roll about which the cloth passes prior to reaching the cloth take-up roll Tension variations in the cloth are sensed at a point between the loom and the cloth roll, rather than at the driven take-up rollers. The tension variations cause the dancer roll to move up and down. The dancer roll is supported by spaced arms affixed to a control shaft which pivots in oscillations. A mechanical chain and sprocket drive transmits oscillations of the control shaft to a variable transformer which varies the voltage signal to the drive motor. The motor control varies the output torque of a variable torque drive motor for maintaining tension in the cloth within a desired range. U.S. Pat. No. 4,216,804, discloses a similar arrangement except that the sensing device, which is also in the form of a dancer roll carried on pivotal arms, eliminates the spring-biasing of the dancer roll, and utilizes gravity instead. In this case, the dancer roll rests on the cloth and is operated by gravity only to vary the torque output of the drive motor in response to tension variations. In this manner, a very light sensitivity is said to be provided which is advantageous in maintaining a preset fabric tension level for very lightweight fabrics. The gravity-type dancer roll continuously varies the motor control to vary the torque output of the drive motor much like U.S. Pat. No. 4,146,190. In these later two patents, variations in cloth tension are continuously sensed by the pivoting dancer roll. In turn, the pivotal movement of the dancer roll continuously varies a variable transformer which continuously varies a voltage signal to the drive motor. For example, in U.S. Pat. No. 4,216,804, a control shaft connected to the spaced pivotal arms which support the dancer roll includes a drive sprocket affixed to one end. A mechanical chain and sprocket drive includes a chain connected to a drive sprocket on an oscillating control shaft of the dancer roll and, to a drive sprocket of a variable transformer. Thus the movements of the dancer roll is mechanically transmitted by the chain and sprocket drive to the motor control to continuously vary the voltage signal and the output torque of the drive motor. While some advantages are afforded by the continuous and variable torque control, other problems are encountered by the need to have continuously moving mechanical and electrical parts. For example, the variable transformer (or rheostat) often forms a weak link in the control system because the small variations in movement of the dancer roll causes the wiper arm of the variable transformer to more or less continuously wipe over the same portion of the transformer windings. Eventually, this may cause the windings to short and the drive to fail. In this case, not only is down time required to replace the transformer device, and repair the control system, but cloth irregularities occur. Moreover, it has been thought that by continuously varying the control signal, possible over control of the system occurs resulting in a telescoping effect in the cloth roll taken up. Certain windings of the cloth roll project relative to other windings in the cloth roll causing undesirable characteristics.

Other controls have also been employed in off-loom take-ups. For example, U.S. Pat. No. 4,633,914, discloses a motor control for an off-loom take-up which detects an unusually high tension in a cloth web being taken up to terminate the take-up drive to prevent stretching and necking of the fabric being handled. The sensing device provides a time delay between sensing of the high tension and termination of the take-up drive. U.S. Pat. No. 5,415,207 discloses an apparatus and method for controlling the drive of an off loom take-up wherein the motor controller controls an electric motor which drives the driven take-up rollers at a preset speed which allows the cloth to travel at the directional speed at which the cloth travels leaving the take-rolls of the loom. This establishes a predetermined downward "creep" in the movement of the pivotal directional roll. The downward movement of the directional roll is sensed by a detector. When the directional roll descends a prescribed distance, the detector momentarily sends a high speed signal to the drive motor which momentarily sends a high speed signal to the drive motor which momentarily steps up the speed of the drive motor and the cloth roll being to take out the slack of the cloth. The present speed is resumed and the high speed signal is discontinued. While intermittent controls, such as high and low speed controls rather than continuously varying speed controls, been used for winding strand material such as wire and the like is shown in U.S. Pat. Nos. 2,104,656 and 2,509,250, these types of controls have not been typically incorporated in loom take-ups for cloth.

Accordingly, an object of the invention is to provide an apparatus and method for controlling the drive of an off-loom take-up in a simple and reliable manner to produce a uniform cloth roll.

Another object of the invention is to eliminate the need for continuous adjustment of a torque or speed output of a drive motor on an off-loom take-up, yet still provide a wound cloth roll of desired characteristics.

Another object of the invention is to provide a control system and method for an off-loom take-up which employs a solid-state electronics drive which eliminates the wear of mechanical parts utilized in previous, similar control devices.

Another object of the invention is to provide a control system and method for an off-loom take-up wherein the tension which the cloth is maintained uniform and an electronic limit processor is used to configure for abnormalities.

Another object of the present invention is to provide a control system and method for an off-loom take-up wherein a preset tension applied by dancer roll to the cloth being wound may be set at a desired value and thereafter maintained uniform during the wind-up process.

SUMMARY OF THE INVENTION

In taking up a web, such as a textile web, from the loom, it is necessary to control the speed of the take up roll being wound on the loom take up. Typically a pivotal dancer arm is utilized to control the speed of the take up roll. The web coming from the loom passes under the dancer roll, around an idler roll, and between two bed rolls as it forms the web take-up roll. The main objective is to maintain the tension on the web generally constant as it forms the take-up roll. The uniform tension eliminates stretch marks, breaking, and other irregularities in the web. In order to maintain the tension generally uniform during wind-up, it is necessary to take the cloth up at the same speed as it is coming off the loom. That is, the web passing between the bed rolls will be traveling at the same rate as it is coming off the loom. If the fabric is coming off of the loom faster than it is being taken up, then it is necessary to increase the speed of the take-up. If the loom speed has decreased, it is necessary to decrease the speed of the take-up. Normally a loom is driven at a constant speed, but due to malfunctions and other problems, the loom speed or output can vary. The speed of the web off the loom will also vary depending on the style of fabric being woven. Therefore, it is necessary that the take-up adjust automatically to the rate at which the cloth is woven and the speed it is taken off the loom.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
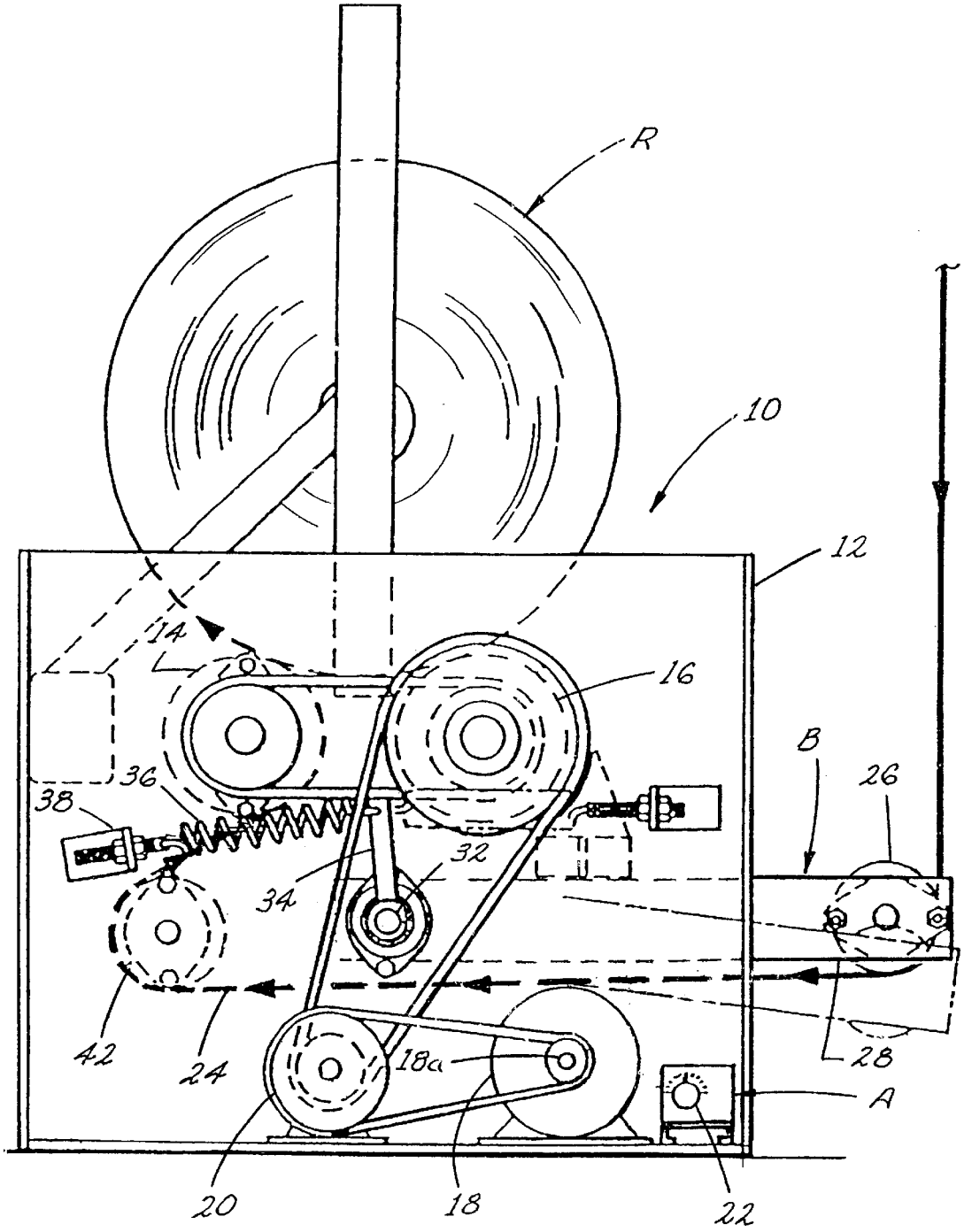
FIG. 1 is a side elevation with parts of the framed housing removed illustrating a drive and control system for an off-loom take-up constructed according to the invention.
Figure 2:
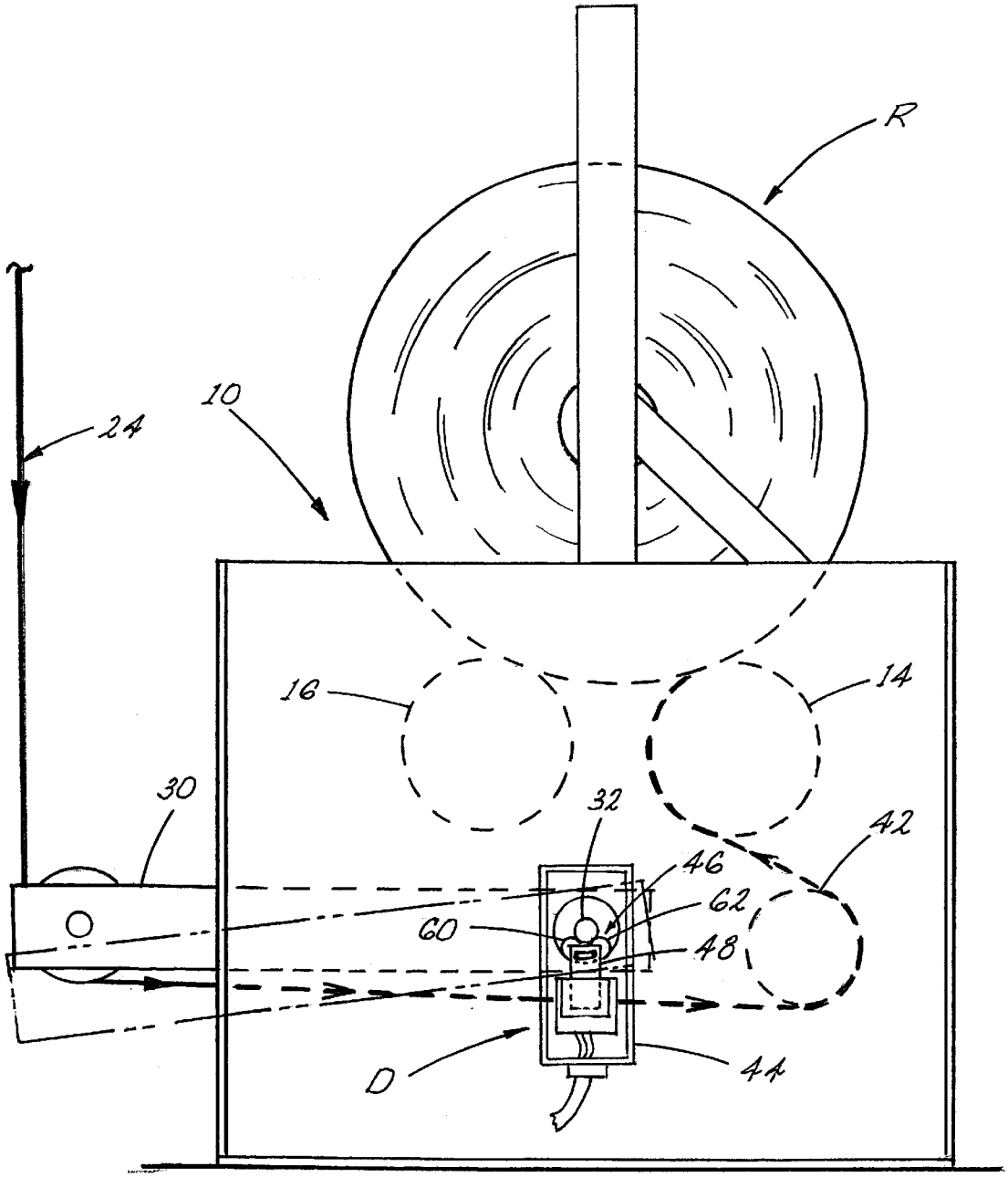
FIG. 2 is a side elevation of an opposite side with parts of the framed housing removed illustrating a drive and control system for an off-loom take-up constructed according to the invention.

As can best be seen in FIG. 1, an off-loom take-up, designated generally as 10, is illustrated which includes a frame 12 and a pair of spaced take-up rolls 14,16. A cloth roll, designated generally as R, which is being wound, is supported in a cradle created between the spaced take-up rolls. As illustrated, take-up rolls 14, 16 are driven by a variable speed DC motor 18 by way of a speed reducer 20. Either a belt/pulley drive, or a chain/sprocket drive connects an output shaft 18*a* of motor 18, the speed reducer and driven take-up roller 16. Take-up roller 14 is interconnected by a drive belt arrangement and is driven off take-up roller 16. This is standard to achieve a desired packing ratio. A motor controller, designated generally as A, is provided for controlling the output speed of motor 18. The controller includes a programmed drive controller 128 (designated generally as C), and includes a manual control knob 22 for setting the output speed of motor 18 hence the drive speed of take-up rollers 14, 16.

A spring-biased dancer roll assembly, designated generally as B, is provided which directs cloth 24 coming from the take off rolls of a loom (not shown) to cloth roll R which is being wound. Dancer roll assembly B includes dancer roll 26 and a pair of spaced, pivotal arms which include a first pivotal arm 28 and a second pivotal arm 30. Arms 28, 30 pivot about a shaft 32 (FIG. 1) having an arm 34 affixed thereto. A biasing spring 36 is attached to the arm at one end and to an adjustable bracket 38 at its opposite end. Adjustable bracket 38 comprises an adjustable threaded bolt and nut which adjusts the spring tension applied by spring 36. A similar adjustable bracket 38*a* is disposed on an opposite side of frame 12 for applying a spring biasing force in an opposite direction. Thus, an interchangeable mount is provided for spring 36 so that the biasing force of the spring may be applied in one of two opposing directions. An idler roll 42 is provided about which the cloth travels on its path to cloth roll R.

Figure 3:
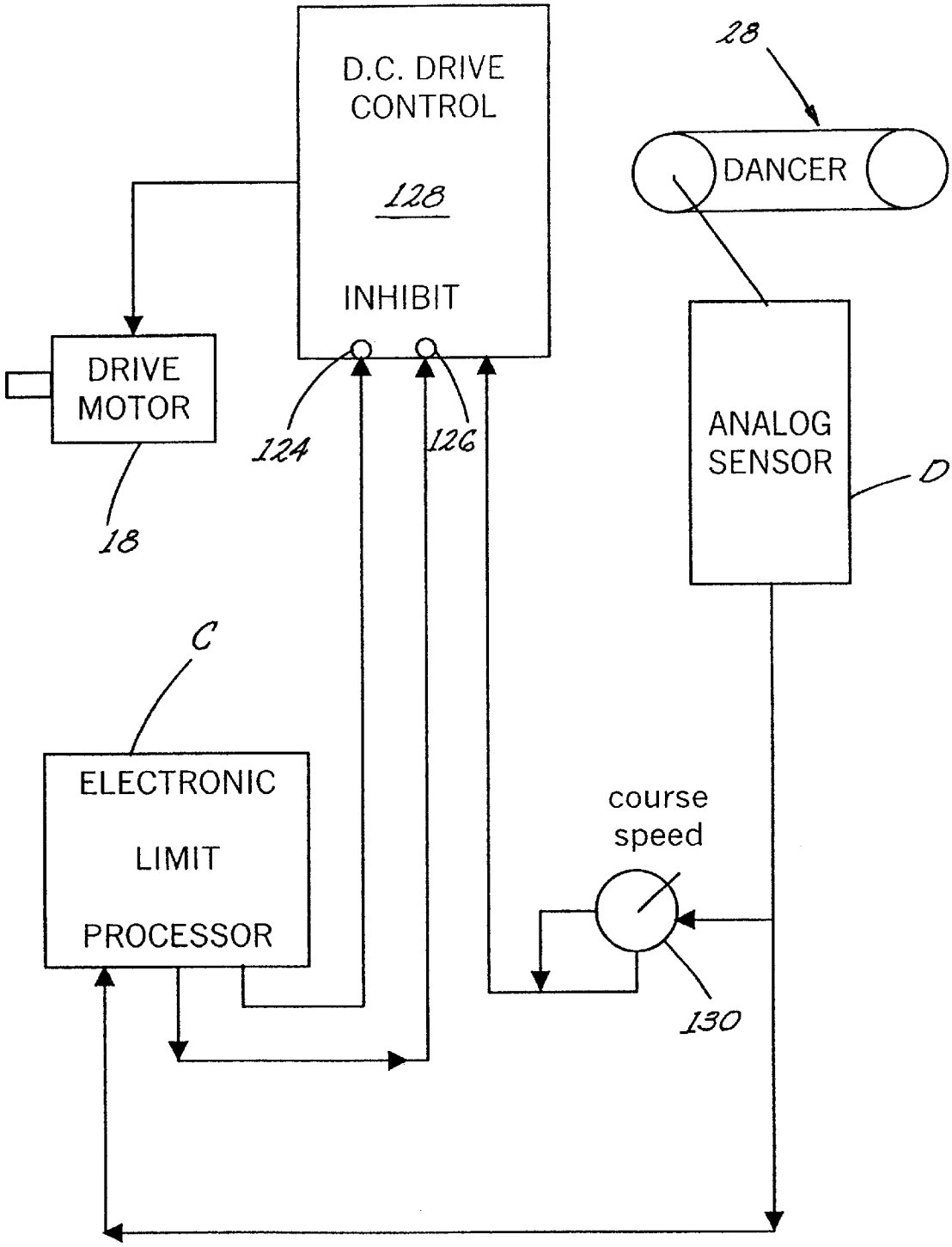
FIG. 3 is a flow diagram of a solid-state method and system for controlling a loom take-up according to the invention.
Figure 4:
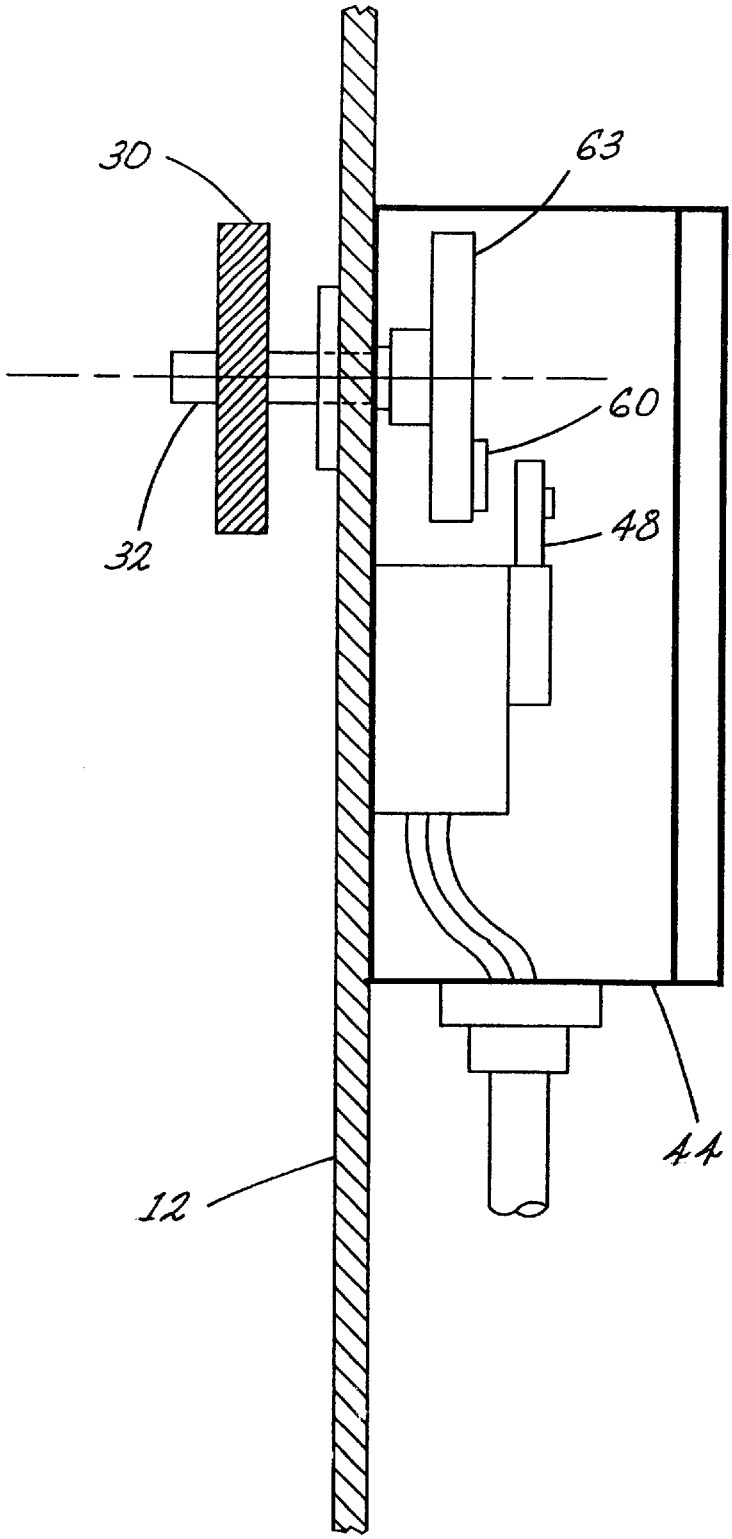
FIG. 4 is a side elevation with parts omitted showing a detector system and method for an off-loom take-up according to the invention.

As can best be seen in FIG. 3. a detector device designated generally as D is illustrated for detecting movement of dancer roll 26. The detector may be carried in any manner to sense the movement of dancer roll 26, and in the illustrated embodiment, the detector device includes a housing attachment 44 which supports a detector, designated generally as, 46, and a detector switch 48. Electrical wiring 50, which transmits an electrical signal produced by detector switch 48, is routed to motor controller A. For this purpose, it is preferred that detector switch 48 be mounted to the frame or housing part 12, by means of attachment 44 and detector object 46 is mounted to shaft 32 for rotation therewith. It is to be understood, of course, that the detector object and detector switch may be mounted in reverse positions, i.e., detector switch 48 mounted on shaft 32 and detector object 46 mounted on frame 12, as well as to other parts of the take-up. However, to simplify the electrical wiring, the illustrated embodiment is preferred. Housing 44 may be adjusted in its vertical position to alter the position at which a detector object 46 comes into proximity with detector switch 48 thereby producing an electrical signal 50*a*.

Any suitable motor controller A may be used in accordance with the invention. One suitable controller is manufactured by K & B Electronics, Inc. of Brooklyn, N.Y., model number KBLC-120. The motor controller is modified by placing a resistor in series with the reference output of the manually adjustable potentiometer which is adjustable by manual knob 22 to provide the preset constant speed and cloth speed differential. A parallel bypass circuit is placed around the resistor containing normally closed contacts. The normally closed contacts are open when a proximity switch is actuated. This places the resistor in the circuit electrically shifts and increases the reference voltage. This results in a voltage increase signal to the motor to momentarily place it in the high speed mode of operation. When the switch is deactuated, the fixed, preset slower speed of the motor is resumed.

According to the invention it has been found that the mechanics used by the prior art to limit the upward and downward movements of pivotal arm 28 can be advantageously replaced by electronic stops. In the event that a malfunction occurs in the take-up drive, causing the termination of cloth take-up, dancer roll 26 will drop, causing an upper electronic limit to be actuated. The upper electronic limit will cause the loom to be shut down until the malfunction is corrected. Likewise, should the loom malfunction, and the take-up continue to wind cloth, dancer roll 26 will be lifted causing a lower electronic to be actuated. This causes the take-up to be shut down until the loom malfunction is corrected. Dancer roll 26 is allowed about 20 degrees of travel between the upper and lower limits.

Figure 6D:
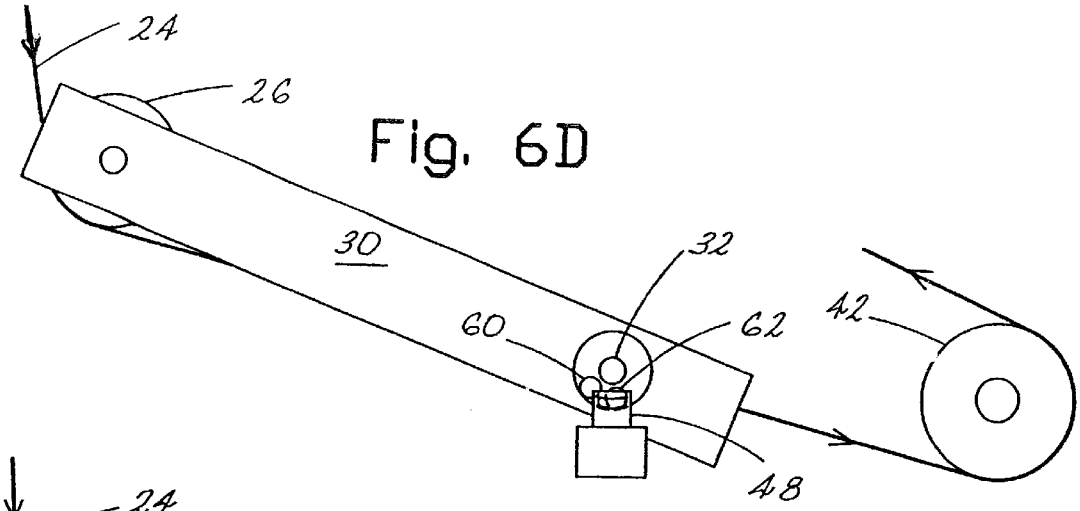
Figure 6C:
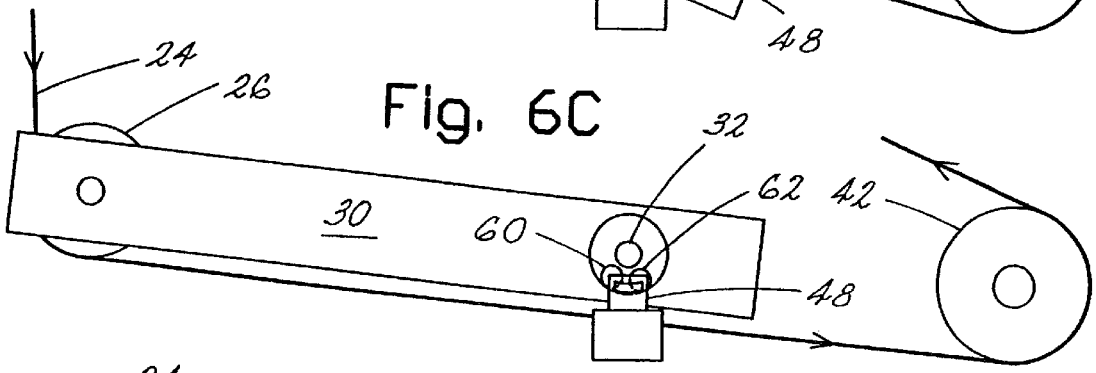
Figure 6B:
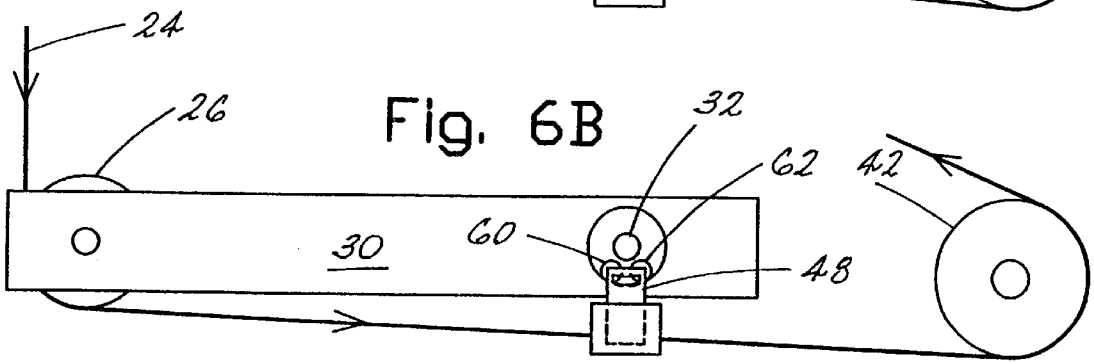
Figure 6A:
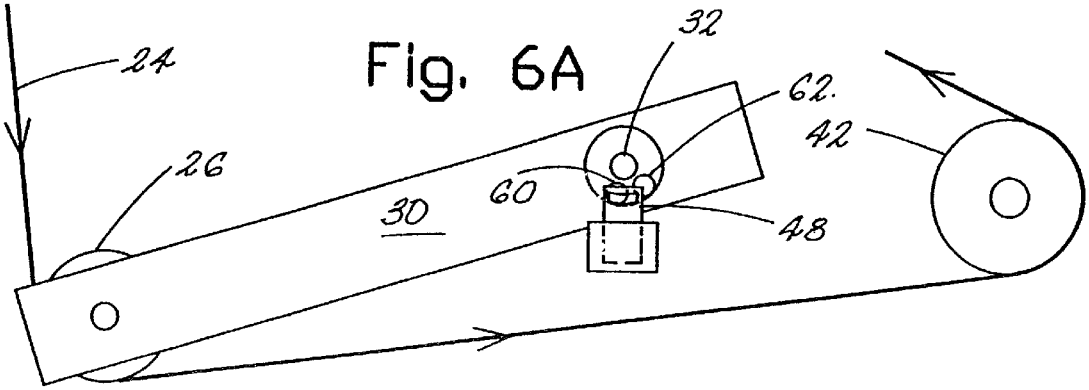

The electronic stops are provided by a detector device D, which senses the pivotal movement of dancer roll 26, and electronic limit processor 13 which receives signals from the sensor to impose limits on the motor drive control. Detector sensor device D is advantageously provided by an analog sensor in the form of a Hall-effect magnetic sensor, designated generally as 60, which senses the rotational position of a dancer arm and dancer roll on a web take-up. The Hall-effect sensor outputs a voltage signal representing the change in the magnetic field caused by movement of the dancer arm. The Hall-effect sensor is connected to an electronic limit processor C. The Limit processor C is a voltage level sensor which takes the voltage signals from the Hall-effect sensor and controls the take-up roll speed. The limit processor can be set to turn the take-up drive on and off at different voltage levels that correspond to operation conditions. There is a low limit which operates in response to the condition when the take-up stops running. In this condition, the dancer arm will be in its lowest position (FIG. 6A) indicating the take-up roll and stopped. There is a run limit sensor which senses if the take-up roll is running. The run limit is reached when the loom has been turned on and the Hall-effect sensor has sensed that the take-up roll is running because the dancer arm has been raised to a level position by the web traveling under the roll (FIG. 6B). Next, there is an inhibit limit which senses the operational condition of the dancer arm being raised above the level position by the web being taken up (FIG. 6C). This results from the take-up running faster than the loom. When the inhibit limit is reached, the take-up is inhibited by using the inhibit feature of the drive controller. This means that the drive motor stops when the inhibit limit is reached. Next there is a high limit and electronics stop, which means that the take-up is running too fast. This condition is sensed by the Hall-effect's sensor by sensing that the dancer arm has reached its uppermost travel position (FIG. 6D). In this condition, the take-up will be turned off. When the high limit is reached, the loom is also turned off until the malfunction is corrected.

Figure 5:
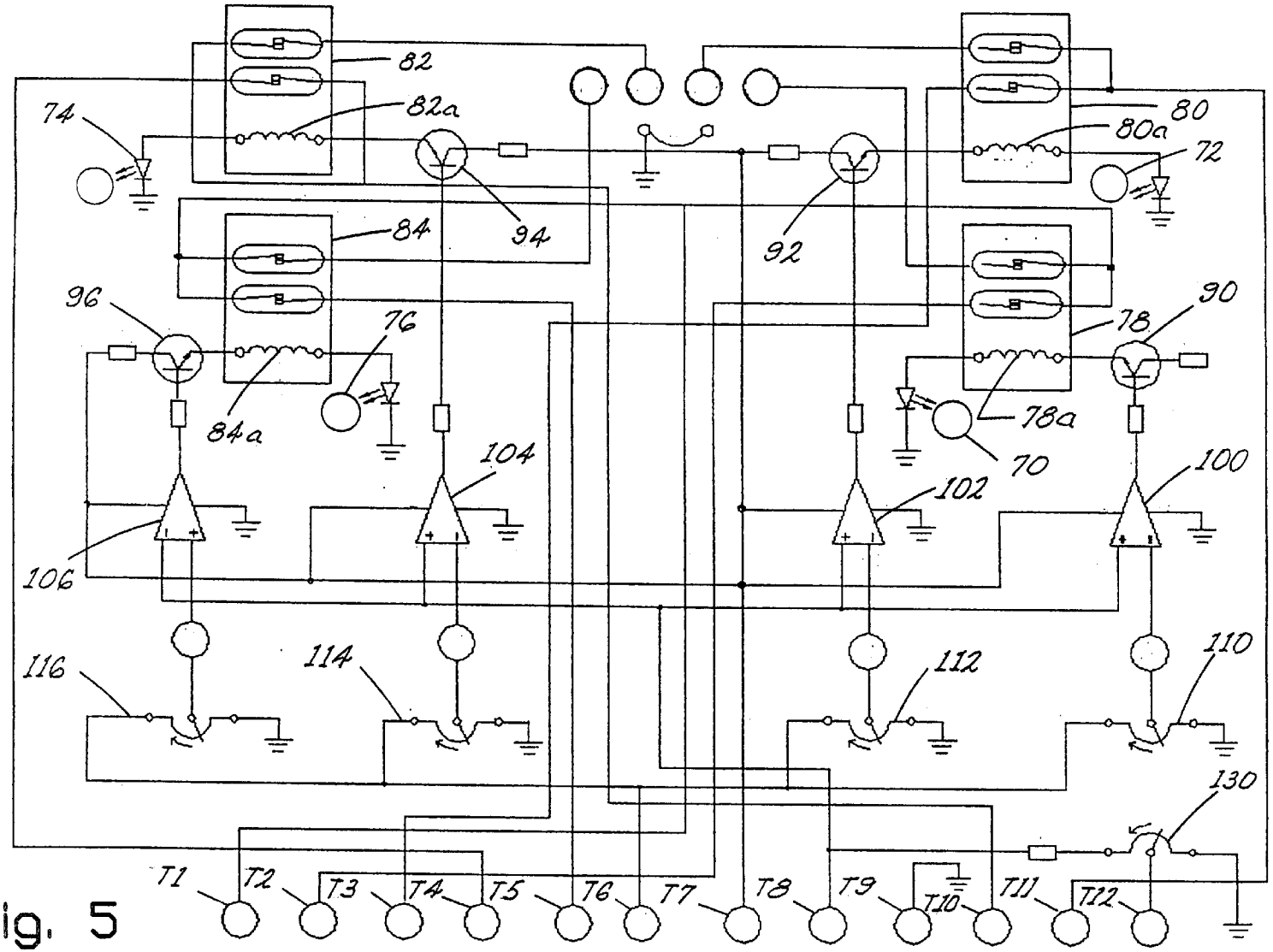
FIG. 5 is a schematic illustration of an electrical control circuit system and method for an off-loom take-up according to the invention; and, FIGS. 6A–6D shows the pivotal dancer roll in the low, run, inhibit and upper limit positions.

As can best be seen in FIG. 5, limit processor B includes a low limit LED 70, run limit LED 72, inhibit limit LED 74, and high limit LED 76. Low limit LED 70 is red, and run limit LED 72 is green. Inhibit limit LED 74 is yellow, and high limit LED 76 is red. There is a relay connected in series with each LED. There is a low limit relay 78, a run limit relay 80, an inhibit limit relay 82, and a high limit relay 84. Each relay includes a coil 78*a*–84*a* in series with the corresponding limit LED. There is a switching transistor associated with each relay for controlling the relay. There is a low limit transistor 90, a run limit transistor 92, an inhibit limit transistor 94, and a high limit transistor 96. There is an operational amplifier connected to the base of each transistor. There is a low limit amplifier 100, a run limit amplifier 102, a inhibit limit amplifier 104, and a high limit amplifier 106. There is a potentiometer connected to an inverted input of each amplifier for setting the limit point at which the amplifier causes the transistor to switch on and activate the relay. There is a low limit set point potentiometer 110, a run limit set point potentiometer 112, an inhibit limit set point potentiometer 114, and a high limit set point potentiometer 116. The set point potentiometer sets the limit point at which the reference voltage from the Hall-effect sensor will cause the limit to be activated. Limit processor C includes a number of input/output terminals T1–T12. There is an inhibit output at terminals T4 and T10 connected to inhibit relay 82. Terminals T4 and T10 are connected to a pair of inhibit contact points 124 and 126 on drive controller 128. A suitable drive controller is manufactured by Penta Corporation of 12095 N.W. 39 Street, Coral Springs, Fla. 33065, identified as model no. KBIC120, "Penta Power." A speed potentiometer 130 controls the speed of a drive motor 18 and may be set initially as desired by knob 22. A terminal 134 provides a trim voltage which transmits to the drive controller to control the speed. There is an output at terminal T2 from the low limit relay which is used to turn off the loom and may also be used to turn off the take-up. There is an output at terminal T3. from the run limit relay which unlatches a bypass limit 140 which keeps the loom from running. At that point in time the take-up is running and the loom is running. When the inhibit outputs from terminals T4 and T10 are received at inhibit contact points 124 and 126, the rotation of the drive motor is inhibited but the drive motor is not turned off. This allows a more sensitive operation of the drive motor.

In operation, the Hall-effect sensor voltage which indicates the position of the dancer may vary from 9 to zero volts, for example as the dancer is raised from the low limit position (FIG. 6A) to the high limit position (FIG. 6D). The solid state limits of Hall-effect sensor 60 may be set up by turning the sensor shaft until the voltage cross terminals T8 and T9 as 9 volts. The shaft and sensor disk are then locked together with a set screw. Next, a block is placed under the dancer arm so it is level (FIG. 6B), and the voltage at terminal T8 and T9 is read. The voltage is adjusted until the green LED 22 comes on by adjusting voltage at terminal T2. The block is then removed and the dancer is lowered until the red LED 20 comes on. Next, the dancer is raised to the inhibit position (FIG. 6C) which is about 5 volts above the level position as read at terminals T8 and T9, and the potentiometer 48 is adjusted until the yellow inhibit LED 24 comes on. The dancer is then raised to the upper limit (FIG. 6 D) which is about 2 volts above the inhibit voltage level as read at terminals T8 and T9. Potentiometer 116 is then adjusted until the high limit red 76 comes on. The dancer may then be raised and lowered through its full arcuate path to insure the limits are operational.

Next, the DC drive and loom start procedures are initiated. To start up the loom, the take up drive must be in a bypass mode to start the loom. The bypass mode is initiated by pushing a run enable push button. The loom starts and when sufficient material is available, the web of material is threaded into the take-up. The take-up control is jogged forward until the dancer is raised sufficiently and the green run light comes on. The analog Hall-effect speed sensor will now be operational to compensate for speed changes. In the event that the stop motion is activated by reaching the upper limit, the take-up may be placed in reverse and the speed control jogged. Ultimately, the take-up speed may be decreased by means of the potentiometer 130 on the solid state limit processor board. If the low limit activates often, the take-up speed may need increasing by means of the solid state potentiometer 130.

While a preferred embodiment of the invention has been described using specific terms, such description is for illustrative purposes only, and it is to be understood that changes and variations may be made without departing from the spirit or scope of the following claims.

What is claimed is:

1. An off-loom take-up for winding a cloth roll from woven cloth coming from a loom comprising:

a frame;

a pair of spaced take-up rollers carried by said frame, at least one of said take-up rollers being a driven take-up roller;

a drive motor having an output shaft for driving said driven take-up roller;

a motor controller for controlling the speed of said output shaft of said drive motor;

a pivotal dancer roll assembly carried by said frame including a pivotal dancer roll under which said cloth travels from said loom to said cloth take-up roll;

a voltage sensor responsive to the movement of said pivotal dancer roll for outputting a plurality of voltage signals correlated to a plurality of different pivotal positions of said dancer roll; and an electronic limit processor for receiving said voltage signals, said processor processing said voltage signals to generate a control signal which is output to said motor controller for controlling said drive motor.

2. The apparatus of claim 1 wherein said sensor senses the pivotal movement of said pivotal dancer roller in a range of pivotal positions from a low limit position to a high limit position relative to said frame and outputs a corresponding voltage signal; and said processor processing said voltage signal to generate a low limit control signal when said dancer roll is in said low limit position, and a high limit when said dancer roll is in said high limit position; said high and low limit control signals being transmitted to said electronic processor; and said processor generating a control signal output to said motor control to stop the operation of said drive motor and hence said take-up when either one of said high and low limit signals are generated.

3. The apparatus of claim 2 wherein said voltage sensor outputs a run voltage signal when said dancer roll is in a run position relative to said frame which is between said low and high limit positions.

4. The apparatus of claim 3 wherein said voltage sensor outputs an inhibit voltage signal when said dancer roll moves to an inhibit position above said run position of said dancer arm relative to said frame; said electronic processor processing said inhibit signal to generate an inhibit control signal which is output to said motor control causing the operation of said drive motor to be inhibited so that rotation of said take-up roller is stopped momentarily.

5. The apparatus of claim 1 wherein said dancer roll is carried by a rotating dancer roll shaft; said voltage sensor including at least one magnet affixed for rotation with said dancer roll shaft; and a voltage sensor chip carried stationarily adjacent at least one said magnet for outputting said voltage signal so that movement of said dancer roll causes said shaft to rotate and the voltage signal output from said sensor chip to vary accordingly.

6. The apparatus of claim 5 wherein said voltage chip includes a Hall-effect transistor chip.

7. The apparatus of claim 6 including first and second magnets carried generally in a side-by-side position for rotation with said dancer roll shaft wherein movement of said first and second magnets is sensed by said sensor chip whereby the voltage signal output by said chip is varied in accordance with the position of said dancer roll.

* * * * *